United States Patent [19]

Hall et al.

[11] 3,981,622

[45] Sept. 21, 1976

[54] HYDRAULIC INTENSIFIER CONTROL SYSTEM

[75] Inventors: Richard W. Hall; Sven Sonnenberg, both of Springfield, Ohio

[73] Assignee: Kelsey-Hayes Company, Springfield, Ohio

[22] Filed: Nov. 20, 1974

[21] Appl. No.: 525,567

[52] U.S. Cl. ..... 417/46; 417/339; 417/344; 417/346; 91/392

[51] Int. Cl.[2] ..... F04B 49/00; F04B 17/00; F04B 35/00

[58] Field of Search ..... 417/46, 342, 344, 345, 417/346, 900, 339, 340, 341, 347; 91/220, 189, 191, 193, 392

[56] References Cited

UNITED STATES PATENTS

| | | | |
|---|---|---|---|
| 2,141,731 | 12/1938 | Wolfrom et al. | 417/345 |
| 2,660,955 | 12/1953 | Kent et al. | 417/346 |
| 3,331,329 | 7/1967 | Bauer | 417/342 |
| 3,477,380 | 11/1969 | Johanson et al. | 417/900 |
| 3,773,438 | 11/1973 | Hall et al. | 417/346 |
| 3,847,511 | 11/1974 | Cole | 417/346 |

*Primary Examiner*—William L. Freeh
*Assistant Examiner*—G. P. LaPointe
*Attorney, Agent, or Firm*—Biebel, French & Nauman

[57] ABSTRACT

An intensifier unit includes a pair of sequentially operated reciprocating ram assemblies, each powered by a cylinder motor. Extension of the cylinder rods is accomplished by application of pressurized hydraulic fluid to the pistons. The pistons are returned quicker than they are extended by means of continuous application of pressurized air to the back side of the pistons. The cylinder motors are precompressed prior to their respective forward strokes by means of an accumulator which continuously bleeds from the main hydraulic fluid supply line. Circuitry is provided to insure that precompression continues even if the ram and its driving piston move from their retracted position. Also disclosed is a safety interlock to shut down the intensifier if both cylinder rods become accidentally simultaneously extended.

7 Claims, 8 Drawing Figures

HYDRAULIC INTENSIFIER CONTROL SYSTEM

BACKGROUND OF THE INVENTION

Hydraulic well stimulation operations such as those involved in fracturing geological formations adjacent deep well bores, erosion drilling, and the like present difficult problems due to the depth of the formation to be fractured, the high pressures required to be generated, the corrosive and abrasive nature of the fluids to be pumped, the long pumping times, and various other factors known to persons skilled in the art.

Conventionally, these operations have been performed by a series of mechanically geared or revolving crank pumps having relatively short strokes and relatively high cycles per minute; for example, eight inch strokes and 120 cycles per minute. Such pumps tend to fatigue and to break down rather readily when used for well stimulation, because of the extreme pressures and the high cycles per minute rate of operation. Such pumps also exhibit pressure pulsations or transient fluctuations which aggravate the adverse effects created by the high rate of fatigue and wear cycles. As a result, effective and profitable well stimulation was impeded.

One successful approach taken to meet this problem was disclosed in U.S. Pat. No. 3,773,438. The device disclosed there was a two cylinder intensifier which maximizes the volume per stroke and reduced the rate of operation by using large diameter pumping rams having relatively long strokes. The intensifier included two hydraulic ram assemblies, each composed of a working ram and a power ram or cylinder for driving the working ram on its forward pumping stroke. Separate return cylinders were provided to drive each ram assembly on its return stroke. Such return cylinders unnecessarily complicated the intensifier.

The hydraulic well stimulation apparatus disclosed in U.S. Pat. No. 3,773,438 also provided for precompression of the rams prior to each forward pumping stroke. This precompression allowed for a smooth transition between the end of the pumping stroke of one ram and the beginning of the pumping stroke of the other ram. Such precompression was accomplished by supplying the driving fluid directly to the ram assembly slightly prior to the initiation of its forward stroke. It was found, however, that pre-application of the driving fluid to accomplish precompression of one ram resulted in a drop in driving fluid pressure to the other ram which was finishing its pumping stroke. This of course resulted in a momentary decrease in the pressure output of the fluid being pumped. Another problem experienced during precompression was that the ram being precompressed might move slightly and deactivate a limit switch which was used to signal the control circuit that the ram was appropriately positioned for precompression.

SUMMARY OF THE INVENTION

The present invention is directed to an improved fluid intensifier for pumping high pressure fluids with an even or pulseless output delivery. As used herein, the terms "ram" or "power ram" refer to one of the piston-type hydraulic cylinder motor assemblies which are each mounted in direct driving relation to an associated one of the working rams. In the preferred embodiment, the intensifier comprises at least one pair of sequentially operated hydraulic ram assemblies each including a working ram, a power ram, a source of pressurized hydraulic fluid, valves for alternately applying the hydraulic fluid to the power rams to cause a forward driving stroke from a retracted position to an extended position, and means for rapidly moving the rams from the extended position to the retracted position when the source of hydraulic fluid under pressure is not being applied to the driving ram. To insure that the transition between the alternate forward pumping strokes of the rams does not cause pressure fluctuation in the output fluid being pumped into the well, each ram is precompressed while in its retracted position prior to each forward pumping stroke. Precompression is accomplished by use of an accumulator which continuously receives hydraulic fluid under pressure from the source of pressurized hydraulic fluid through a restricted orifice. Precompression is initiated when the ram returns to its retracted position and continues even though the ram might thereafter move off this position. The means for rapidly moving the rams from the extended position to the retracted position in the preferred embodiment comprises a source of air under pressure which is continuously supplied to the power rams in a direction tending to urge their retraction. Finally, a safety interlock is provided such that accidental simultaneous extension of both rams results in disconnection of the hydraulic fluid source from the rams.

Accordingly it is an object of this invention to provide an improved pumping device having ram assemblies which use pressurized gas to effectuate the return strokes of the rams.

It is also an object to provide an improved pumping device having a safety interlock arrangement responsive to a distortion in the pumping sequence.

It is also an object of this invention to provide an improved pumping device having ram assemblies which are operated alternately and in which the power rams are precompressed prior to each cycle of operation so as to maintain a smooth pressure output in the fluid being pumped by the working rams. It is further an object to maintain such precompression even if forward movement of the ram should occur.

DESCRIPTION OF THE PREFERRED EMBODIMENT

Figure 1A:
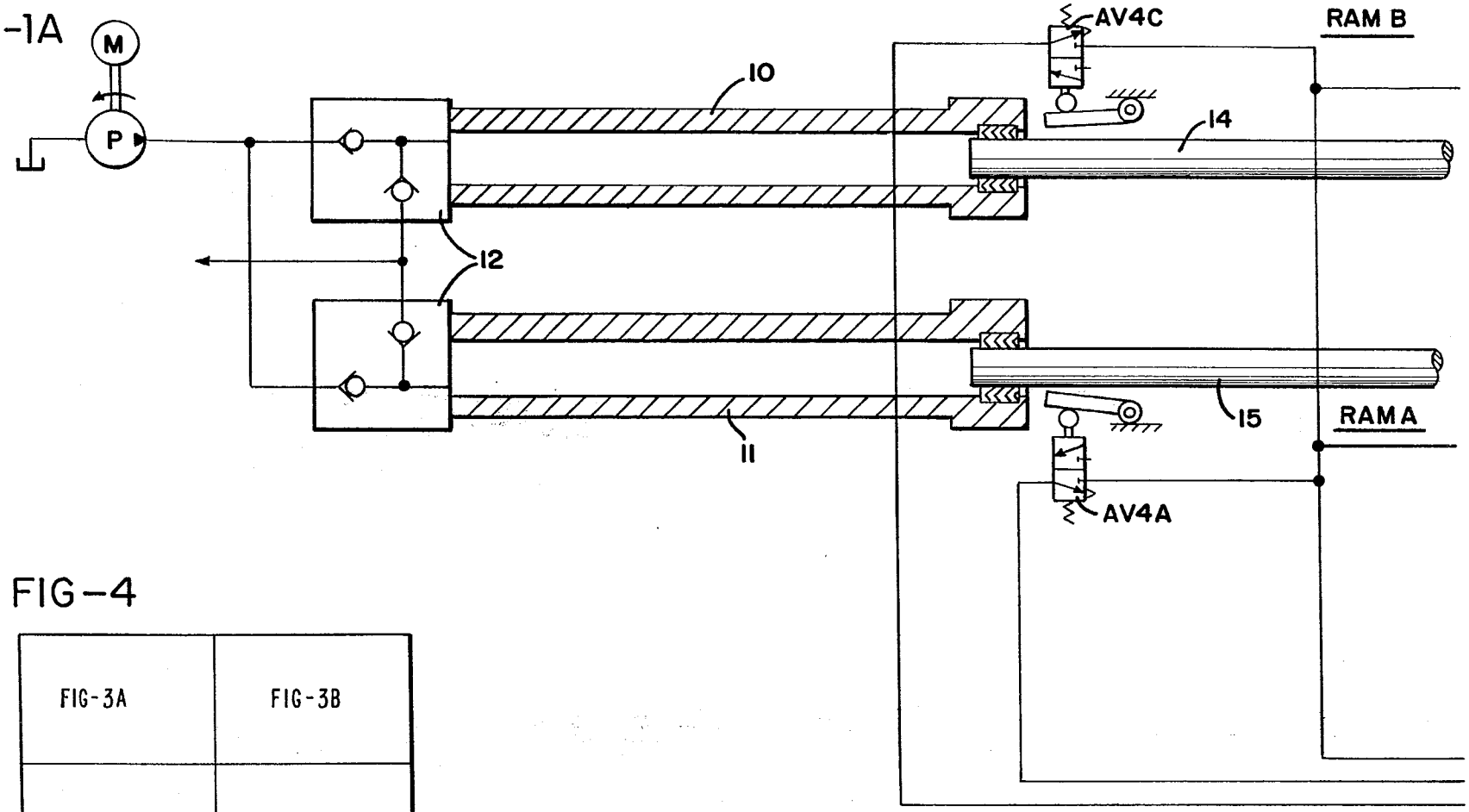
FIGS. 1A and 1B, when assembled, provide a schematic representation of the intensifier ram assemblies, the hydraulic fluid valves and the pneumatic control circuit.
Figure 1B:
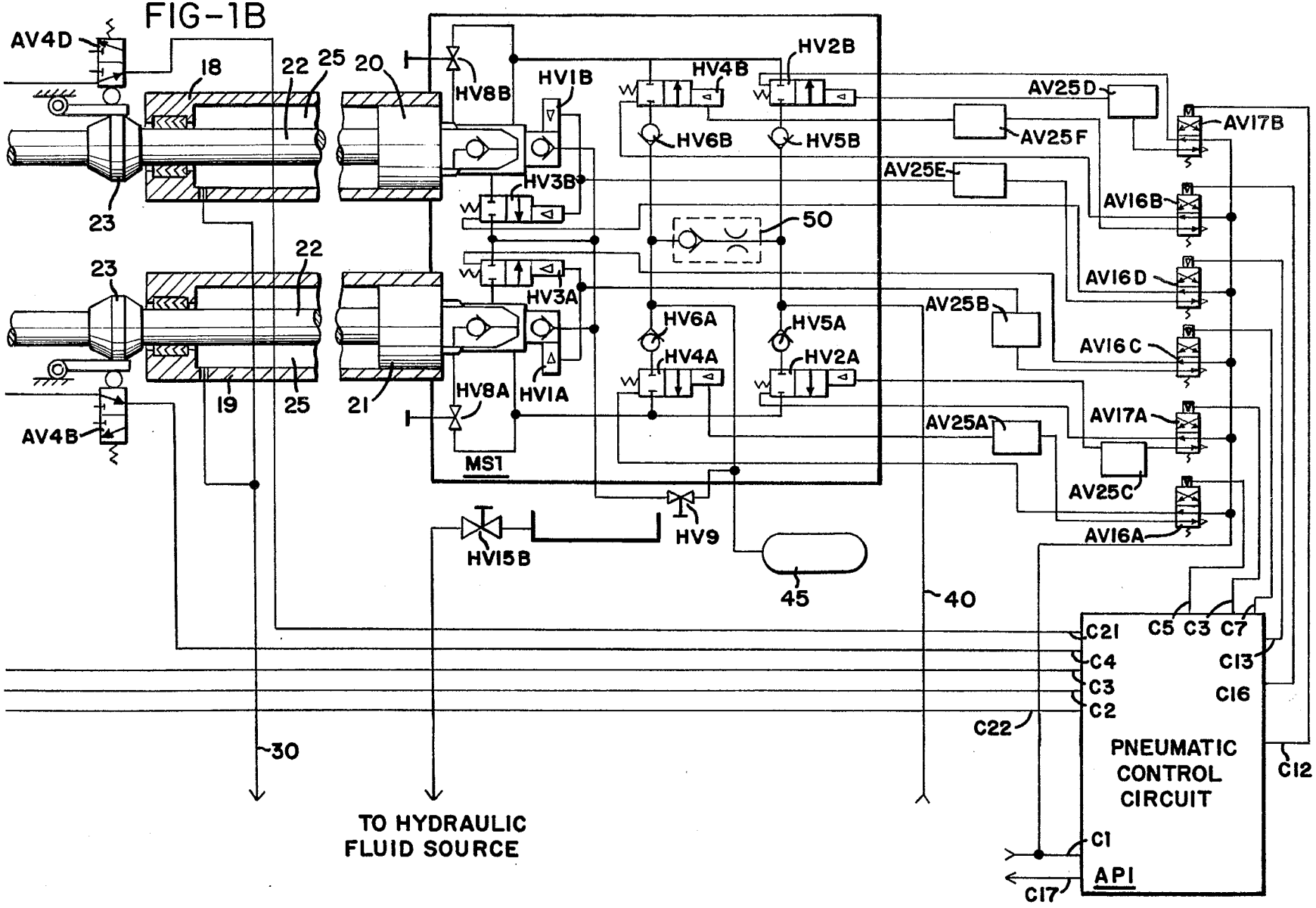

Referring to FIGS. 1A and 1B, the intensifier of the present invention employs a pair of intensifier units which convert a relatively high-pressure driving fluid into a high pressure working fluid output. The intensifier construction illustrated diagrammatically in FIGS. 1A and 1B is described in greater detail in the copending application of Hall et al, Ser. No. 525,568 filed concurrently herewith. Thus, the apparatus includes a pair of side-by-side ram assemblies A and B each comprising a working ram driven by a power ram or, more precisely, a piston operated elongated cylinder motor. The output of the working rams is applied through suitable valving under extreme high pressure for fracturing geological formations adjacent the boreholes or for erosion drilling or the like. The working rams thus include a pair of cylinders 10 and 11 having their outputs connected to the well through suitable check valving illustrated generally at 12. The working pistons 14 and 15 are associated respectively with the cylinders 10 and 11 and extend rearwardly thereof.

The power ram portions include a pair of hydraulic cylinders 18 and 19 which respectively contain pistons 20 and 21. Each of the pistons is provided with a forwardly extending piston rod 22 which extends through the forward end of the respective cylinder in direct-coupled relation to one of the working pistons 14 or 15 through a coupling 23. Since the piston rods 22 are formed with a smaller diameter than that of the pistons 20 or 21, annular spaces 25 are formed forwardly of the pistons within the cylinders 18 and 19.

Forward movement of each of the rams is accomplished by the valved and timed application of hydraulic fluid under pressure to the rear faces of the pistons 20 and 21 resulting in alternate movement of the associated rams from their fully retracted positions as shown in FIGS. 1A and 1B to a forward or extended position. This results in the compression and uniform delivery of the working fluid from within the working ram cylinders 10 and 11 to the well. Typically, hydraulic pressure in the range of 5500–7000 psi is applied to the power rams causing intensification of working fluid pressure up to 21,000 psi or more, depending on the relative cross-sectional areas of the driving piston 20 and 21 and the working pistons 14 and 15. Each of the rams A and B is returned from an extended position to a retracted position essentially by means of air applied under a constant head or pressure into the annular space 25 ahead of the pistons 20 and 21. A return force is thus applied to the associated piston sufficient to return the rams to their retracted position at a rate which exceeds that of the extending movement. It has been found that air under pressure in the range of 75 to 150 psi is satisfactory for this purpose and, since this is a relatively low pressure, it may be applied at all times to the interior of the space 25 without interference with the operation of the intensifier.

Movement of the driving pistons is monitored by pneumatic limit switches AV4D, AV4B, AV4C and AV4A. The first two are opened when the rams are in the back or retracted position while the latter two are opened when the rams reach the forward or extended position.

Application of hydraulic driving fluid to the intensifier pistons is controlled by the hydraulic valves in valve unit MS1. These valves function as follows. Hydraulic driving fluid is supplied to unit MS1 by line 40 which is connected to a suitable high pressure source. Consider for a moment the operation of ram A. The hydraulic driving fluid is supplied to this ram via admission valve HV2A. After the completion of a forward stroke, the driving fluid must be exhausted from the ram cylinder to allow the pressurized air to return the piston to its initial position. This is accomplished by means of two valves. Relatively small decompression valve HV3A is opened allowing the pressure to drop sufficiently so that exhaust valve HV1A can be opened.

The driving fluid is then exhausted through valve HV1A. A cushion effect is accomplished by means of valve HV8A whereby the ram is brought to a smooth stop at the completion of the return stroke. This feature is more completely disclosed and described in copending U.S. application Ser. No. 525,568, filed Nov. 20, 1974, and assigned to the assignee of the present application. Prior to the initiation of each forward stroke of ram A, the ram is precompressed by means of valve HV4A and accumulator 45. This accumulator receives a constant charge of hydraulic fluid by means of valve 50 which defines a restricted or a bleed orifice connected continuously to bleed line 40. The valve arrangement provided for ram B is identical to that discussed above in relation to ram A. By this arrangement fluid pressure for prepressurization is taken from the hydraulic pressure source line 40 without any significant drop or surge in line pressure.

Figure 2:
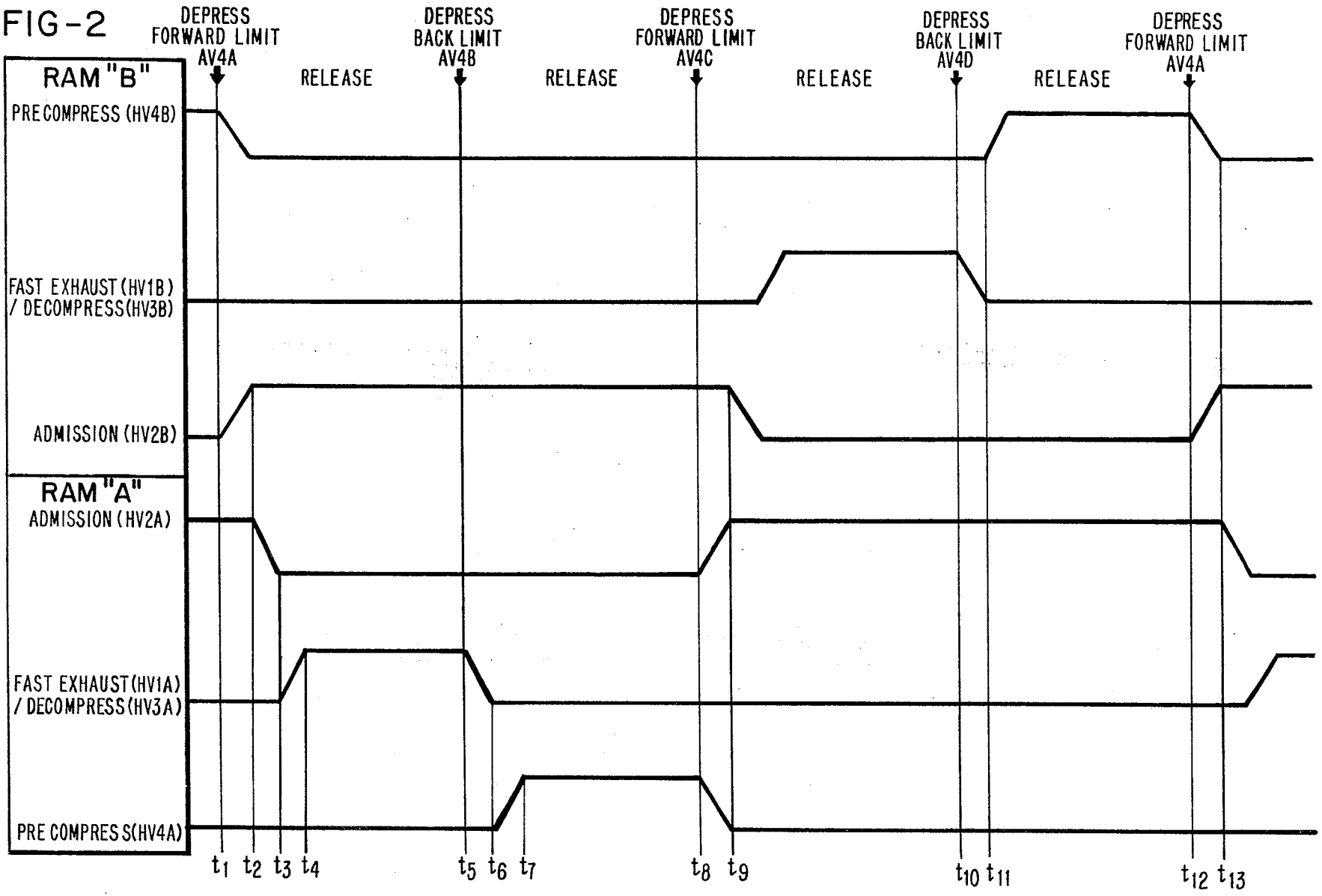
FIG. 2 is a timing diagram showing the sequence of operation of the hydraulic valves controlling movement of the rams.
Figure 3A:
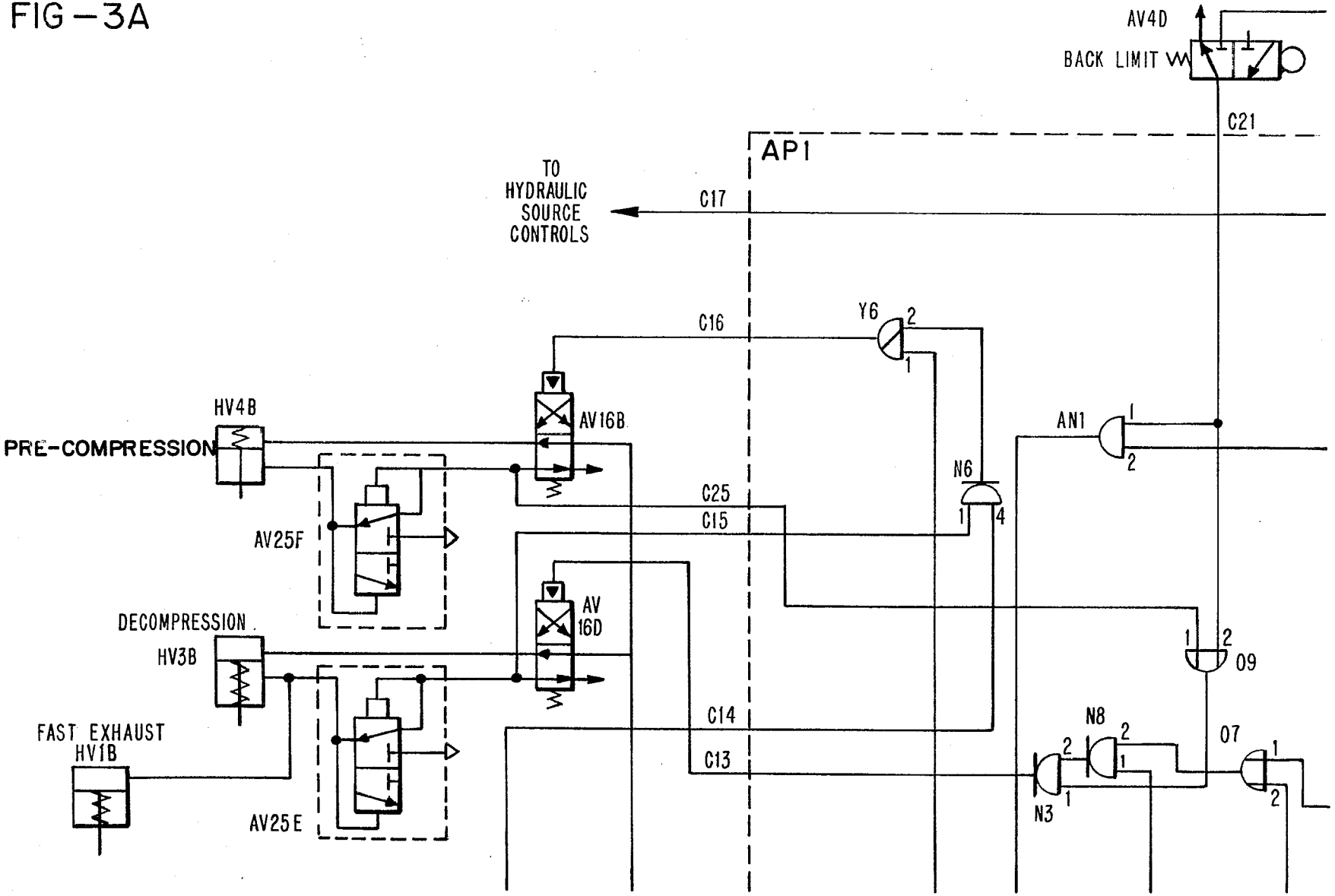
FIGS. 3A–3D, when assembled, provide a schematic representation of the pneumatic control circuit and associated valves.
Figure 3B:
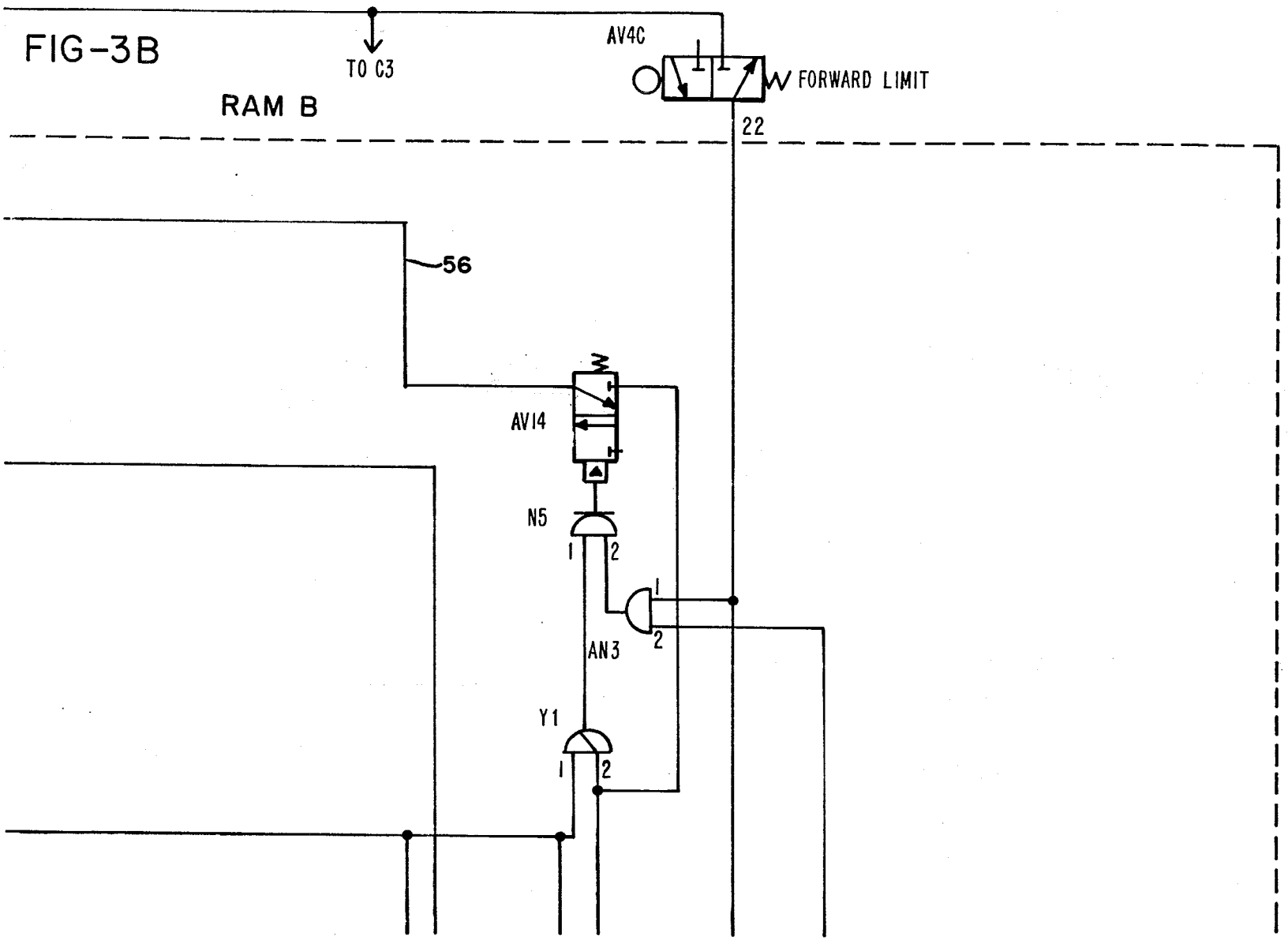
Figure 3C:
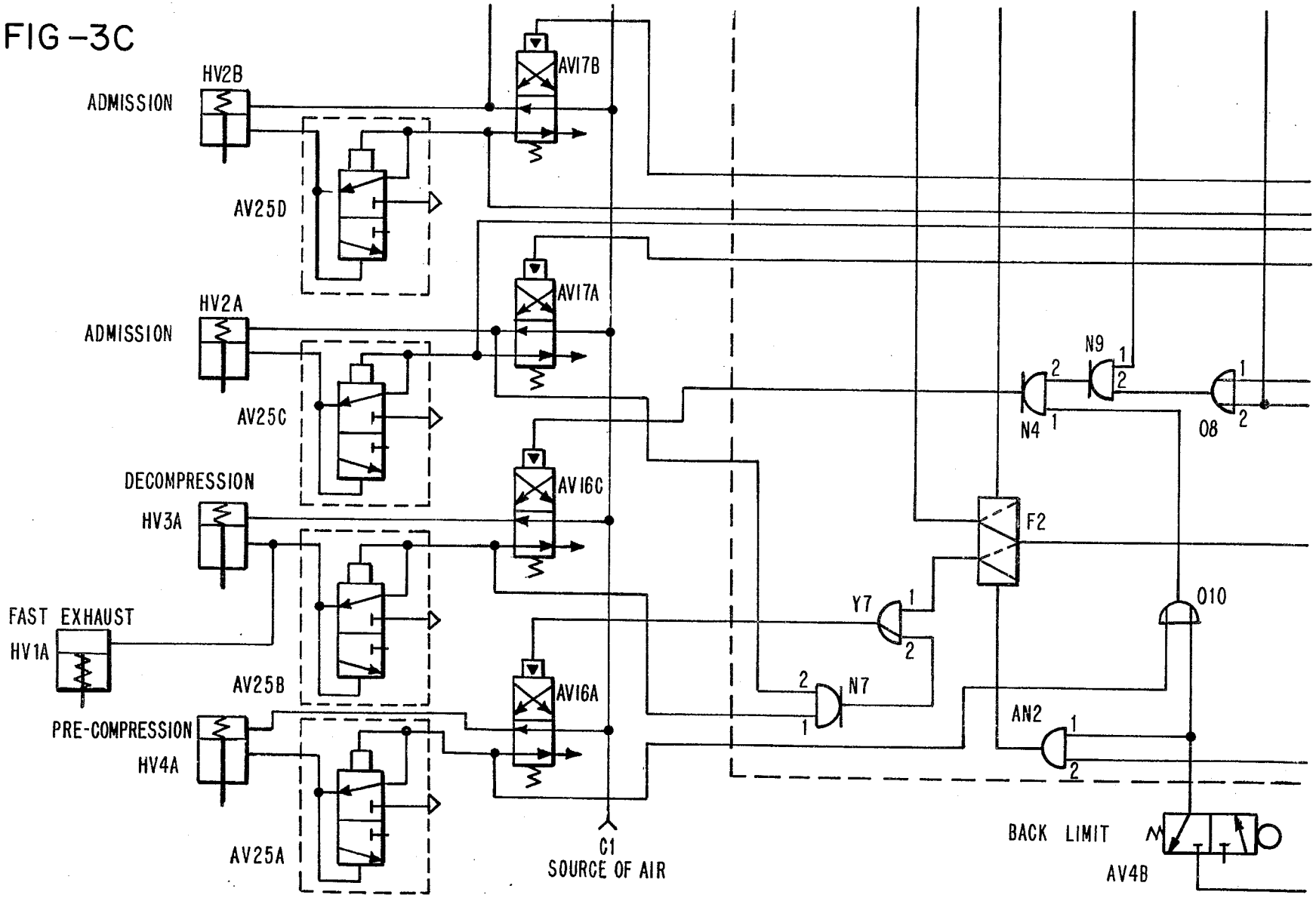
Figure 3D:
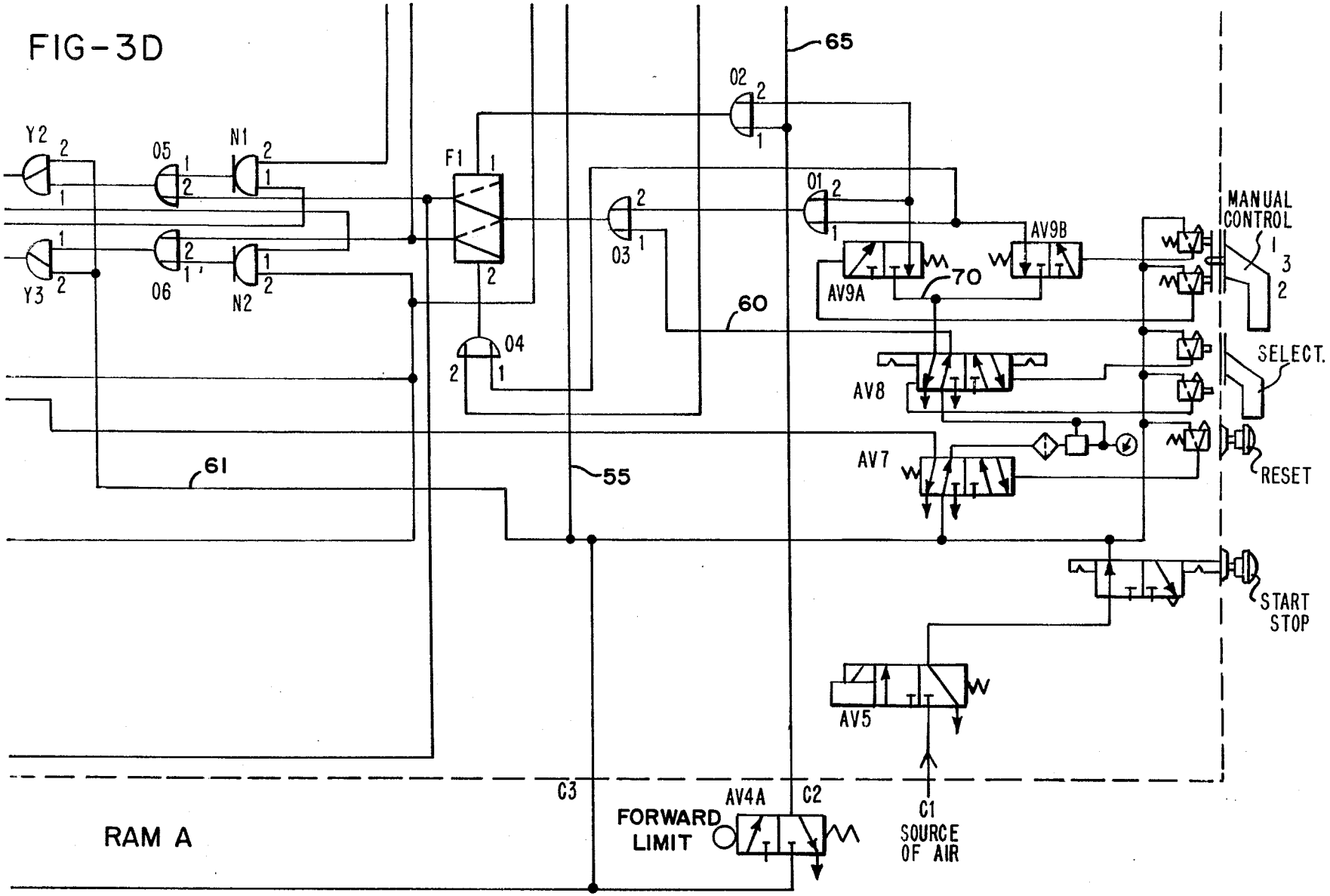

The operational sequence of the valves in valve unit MS1 is shown diagrammatically in FIG. 2. Assuming that ram B is about to begin a forward stroke at time *t*1, a valve HV2B is opened to admit driving fluid to the ram and precompression valve HV4B is closed. Admission valve HV2B is completely open and ram B begins its forward stroke at time *t*2. At this time, ram A completes its forward stroke and admission valve HV2A begins to close. At time *t*3, the closure of admission valve HV2A is completed and the fast exhaust valve HV1A and decompression valve HV3A are actuated to allow ram A to return to its retracted or back position. Retraction is accomplished between times *t*4 and *t*5, and the exhaust valve HV1A and decompression valve HV3A are then completely closed by time *t*6. Precompression of ram A is then initiated and precompression valve HV4A is completely opened by time *t*7. The precompression valve HV4A remains open until time *t*8 when ram B trips forward limit switch AV4C. The precompression valve HV4A then begins to shut and admission valve HV2A opens completely by time *t*9 so as to start ram A on its forward stroke. Admission valve HV2B is then closed and fast exhaust valve HV1B and decompression valve HV3B are then opened to allow ram B to return to its retracted position. This is accomplished by time *t*10, when back limit switch AV4D is actuated. At time *t*11 when the fast exhaust valve HV1B and the decompression valve HV3B have been completely closed, precompression valve HV4B is opened to ready ram B for its next forward stroke. At time *t*12 ram A actuates forward limit switch AV4A and admission valve HV2B is opened so as to start ram B forward at time *t*13. This completes one cycle of operation.

Figure 4:
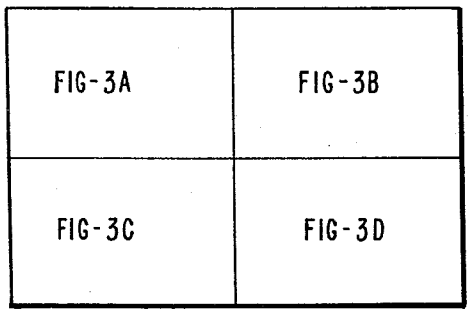
FIG. 4 shows the interrelationship between FIGS. 3A–3D.

Referring now to FIGS. 3A–3D, which are assembled as shown in FIG. 4, there is disclosed schematically pneumatic circuit AP1 for providing appropriate control of the hydraulic valves in unit MS1. A supply of pressurized air is provided to the control circuit by way of line C1. The control circuit is turned on by actuation of manual On/Off switch AV6 and remote On/Off switch AV5 so as to supply air to line 55. Air from this line then passes to line 56 to enable a set of control valves (not shown) which control loading of the pumps in the hydraulic fluid source. Should the pressure be removed from line 56, the hydraulic fluid source would be immediately shut down.

A safety interlock is provided wherein simultaneous extension of both rams to their respective forward positions results in the shut down of the hydraulic fluid source. This is accomplished by closing valve AV14 which in turn removes the pressure from line 56. Valve AV14 is closed when AND gate AN3 provides a "1" output to NOT gate N5 and this in turn occurs when both forward limit switches, AV4C and AV4A, are actuated simultaneously.

It should be noted initially that the inputs to pneumatic valves AV16B, AV16D, AV17B, AV17A, AV16C, and AV16A are provided on control circuit output C16, C13, C12, C9, C7, and C5 respectively. A "1" on any of these lines will result in actuation of the associated pneumatic valve. These pneumatic valves in turn provide the control for the hydraulic valves in unit MS1 shown in FIG. 1. A "1" on any of the previously mentioned control circuit output lines, therefore, results in the opening of the associated hydraulic valve.

Automatic Operation

In the automatic mode of operation, compressed air from line 55 is supplied by way of reset valve AV7 (to be described later) to AV8 which in turn supplies line 60. OR gate 03 then supplies a signal to the F input of flip-flop F1. Assuming that F1 is initially set to have a signal supplied to the X output, OR gate 06 will provide a "1" at its output. Since the supply input 2 of YES gate Y3 receives a supply on line 61 whenever the control circuit is operating, the "1" output of the OR gate 06 is passed to line C9 with the result that AV17A is actuated. The admission valve HV2A of ram A is opened and the ram is therefore operated in a forward stroke.

When ram A nears the end of its forward stroke, forward limit switch AV4A is actuated, supplying a signal to line 65. OR gate 02 then acts to set flip-flop F1 so that a "1" is supplied to the $X_q$ output. Admission control valve AV17A is not immediately deactivated, however, since NOT gate N2 will continue to supply a "1" to OR gate 06. YES gate Y3 will continue to supply a signal to keep the admission valve of ram A open. When admission control valve AV17B of ram B is completely open, NOT gate N2 will be disabled as a result of the signal on line C11. The admission valve of ram A will consequently be closed.

For ram A to be quickly returned to its retracted or back position, valve AV16C must be actuated to open decompression valve HV3A and fast exhaust valve HV1A. Valve AV16C is actuated when three conditions coincide: the admission valve for ram A is completely closed, the precompression valve for ram A is closed, and ram A is not in its retracted position. The last two conditions will result in "0" inputs to OR gate 010 which will thus have a "0" output. NOT gate N4 will then have a "1" output provided it receives a signal on its supply input. This occurs when there is a "0" on the 1 input to NOT gate N9 as a result of the complete closure of the admission valve for ram A. The supply input to NOT gate N9 is continuously supplied during operation of the circuit by OR gate 08 which receives a "1" input 1 when the circuit is in the automatic mode.

Ram A now returns to its back or retracted position as a result of the air pressure continuously supplied to the ram as explained previously. When the ram reaches this back position, back limit valve AV4B is actuated, supplying a signal to OR gate 010 which in turn supplies a signal to NOT gate N4. This results in the closure of the decompression and fast exhaust valves for ram A.

AND gate AN2 also receives a signal from back limit valve AV4B and, since it is also receiving a "1" from the $X_q$ output of flip-flop F1, it supplies a "1" to the $Y_{EXT}$ input of flip-flop F2. Flip-Flop F2 then provides a "1" on its Y output with the result that the precompression control valve AV16A is actuated by way of YES gate Y7. NOT gate N7 provides the supply input to YES gate Y7 and is inserted in the circuit to insure that the admission, decompression, and fast exhaust valves of ram A are closed before precompression of ram A is begun. If these valves were not closed, precompression could not be effected. The flip-flop F2 is provided in the control circuit to insure that the precompression step continues even if the ram should wander off of the back limit switch. A slight movement of the ram may frequently occur during the first few cycles of operation of the system while there is still some air in the hydraulic lines. Ram A continues precompression for most of the remainder of the forward stroke of ram B.

As ram B nears the end of its forward stroke, forward limit switch AV4C is actuated and therefore supplies a signal to OR gate O4. This in turn resets flip-flop F1 so that admission control valve AV17A of ram A is actuated. Actuation of valve AV17A is sensed by NOT gate N7 with the result that YES gate Y7 is disabled and the precompression of ram A ends. With the admission valve for ram A open, the ram begins its next forward stroke.

While a complete cycle of operation in the automatic mode has been described mainly with respect to ram A, it is clear from the drawings that the controls for ram B are identical to those for ram A and that the control circuitry for the two rams functions identically.

Manual Operation

When operator control is desired, the system is switched into the manual operating mode by actuation of valve AV8 so as to supply the pressurized air from line 55 to line 70. In this mode of operation, movement of the rams is controlled by manual actuation of valves AV9A and AV9B. These valves set and reset flip-flop F1. If neither AV9A nor AV9B is actuated, neither of the rams will move. This is so because the admission control valves AV17A and AV17B cannot be actuated when the supply signals on inputs 2 to NOT gates N1 and N2 are removed at the same time that the F input to flip-flop F1 is eliminated.

Reset

If return of both rams to the back or retracted position should be desired, the reset valve AV7 is manually actuated to supply a signal to OR gates 07 and 08. Actuation of valve AV7 also results in both outputs of flip-flop F1 being set to "0". Thus neither admission control valve, AV17A or AV17B, will be actuated and as a result NOT gates N9 and N8 both have "1" outputs. NOT gates N3 and N4 will therefore actuate valves AV16C and AV16D to allow retraction of both rams.

While the form of apparatus herein described constitutes a preferred embodiment of the invention, it is to be understood that the invention is not limited to this precise form of apparatus, and that changes may be made therein without departing from the scope of the invention.

What is claimed is:

1. In a hydraulic intensifier for oil well fracturing, erosion drilling or the like, in which a pair of working rams are sequentially operated by a corresponding pair of hydraulic cylinder motors from a source of hydraulic fluid under high pressure and in which said motors move between retracted and extended positions, the improvement comprising:

first valve means for applying hydraulic fluid from said source selectively to said cylinder motors for causing extending movement thereof and a corresponding working stroke of the ram associated therewith, accumulator means connected to said source through means defining a restricted orifice to bleed off a portion of the output of said source, second valve means responsive to the return of each of said cylinder motors to their corresponding retracted positions for connecting said motors to said accumulator means for precompressing said motors prior to the initiation of the direct application of hydraulic fluid from said source, means responsive to the arrival of each of said cylinder motors toward their respective extended positions for applying hydraulic fluid from said source to the other motor which has been precompressed in its retracted position, so that the output pressure of the intensifier remains essentially uninterrupted, means for depressurizing each said cylinder motor at its extended position upon the direct application of said source to the other motor, and means for returning each said depressurized cylinder motor from its extended position to its retracted position at a rate which exceeds the rate at which said motors move from their respective retracted positions to their extended positions.

2. The intensifier of claim 1 in which said means for returning comprises a source of air under pressure, and means applying said source of air under pressure continuously to said cylinder motors in a direction tending to urge said motors to their retracted position.

3. The intensifier of claim 1 further comprising control means which respond upon the simultaneous occurrence of said cylinder motors at their respective extended positions for removing hydraulic pressure therefrom to prevent damage to the intensifier.

4. The intensifier of claim 1 in which said accumulator means is continuously connected to said source through said restricted orifice so that precompression is accomplished without significant variation in the hydraulic pressure from said source.

5. The hydraulic intensifier of claim 1 wherein said second valve means comprises:

switch means for sensing the return of said motors to their respective retracted positions, means responsive to said switch means, for connecting said accumulator means to said motors, and means for maintaining the connection between said accumulator means and said motors until said motors are connected by said first valve means to said source, whereby precompression is continued even though said motors may not remain completely retracted.

6. Hydraulic well fracturing equipment comprising a first hydraulic assembly having a power ram and a second hydraulic assembly having a power ram, each of said rams having an extended and a retracted position, a source of pressurized hydraulic fluid, valve means for alternately applying said fluid to said rams to cause said rams to move from said retracted position to said extended position, means for rapidly moving said rams from said extended position to said retracted position when said hydraulic fluid is not being applied thereto, and means for precompressing the residual hydraulic fluid in said rams prior to application of hydraulic fluid to said rams from said source, said means for precompressing including an accumulator continuously receiving hydraulic fluid from said source through a restricted orifice.

7. The equipment of claim 6 wherein said means for precompressing further comprises means for applying hydraulic fluid from said accumulator to said rams to precompress said rams and for continuing such precompression regardless of subsequent movement of said rams.

* * * * *